United States Patent [19]

Asai et al.

[11] Patent Number: 4,582,270

[45] Date of Patent: Apr. 15, 1986

[54] METHOD OF TRANSFERRING YARN PACKAGES IN A SPINNING FRAME

[75] Inventors: Isao Asai, Toyota; Mitsunori Horiuchi, Kariya; Shigeru Muramatsu, Okazaki, all of Japan

[73] Assignee: Kabushiki Kaisha Toyoda Jidoshokki Seisakusho, Kariya, Japan

[21] Appl. No.: 724,046

[22] Filed: Apr. 18, 1985

Related U.S. Application Data

[63] Continuation of Ser. No. 506,296, Jun. 21, 1983, abandoned.

[30] Foreign Application Priority Data

Jun. 26, 1982 [JP] Japan ..... 57-110079

[51] Int. Cl.[4] ..... B65H 54/20; B65H 67/06

[52] U.S. Cl. ..... 242/35.5 A; 242/35.6 R

[58] Field of Search ..... 242/35.5 A, 35.5 R, 242/35.6 R; 57/276

[56] References Cited

U.S. PATENT DOCUMENTS 3,160,359 12/1964 Furst ..... 242/35.5 R 3,939,634 2/1976 Yoshizawa et al. ..... 242/35.5 A

FOREIGN PATENT DOCUMENTS 2816418 10/1979 Fed. Rep. of Germany ..... 242/35.5 A

*Primary Examiner*—Stanley N. Gilreath

*Attorney, Agent, or Firm*—Brooks Haidt Hafner & Delahunty

[57] ABSTRACT

A method of transferring full packages in a spinning frame having a plurality of spinning stations arranged in a row on each longitudinal side of the frame, a single run package transferring conveyor disposed between the opposite rows of the spinning stations and a doffing unit which provides doffing service at each spinning station while traveling around the machine, is provided herein. The doffing unit performs its doffing service at a station which calls for doffing of its full package only when a package is absent on the conveyor at a position corresponding to the station at which the doffing unit is then stopped, but it defers its doffing operation at the station if a package is present at said corresponding position on the conveyor. The conveyor is caused to move when the number of those packages which are undoffed due to deferment amounts to a predetermined value.

4 Claims, 6 Drawing Figures

METHOD OF TRANSFERRING YARN PACKAGES IN A SPINNING FRAME

This application is a continuation, of application Ser. No. 506,296, filed June 21, 1983, now abandoned.

FIELD OF THE INVENTION

The present invention relates to a method of transferring yarn packages in a textile machine such as an open-end spinning frame or a winder having a plurality of yarn spinning or winding units arranged in a row on each longitudinal side of the machine. More specifically, the invention relates to a method of transferring full packages in a spinning machine having a single run package conveyor extending along the longitudinal center of the machine to an end thereof.

BACKGROUND OF THE INVENTION

In a textile machine such as an open-end spinning machine which includes a plurality of spinning units or stations juxtaposed in a row on each side thereof and a single run package transferring conveyor disposed extending centrally along the spinning units on each side to an end of the spinning machine for conveying doffed full package, there is a fear or a disadvantage in that a full packages doffed from a spinning unit on one side of the machine onto a conveyor will cause an interference with a full package, if any, which has been already doffed from another spinning unit positioned just opposite the spinning unit on said one side and is still placed on the conveyor. The fact that the width of a full package, or the axial dimension thereof, is usually made larger than half of the interval distance at which the spinning units on each side of the machine are spaced from each other, makes it more difficult to prevent such interference between doffed full packages.

An arrangement proposed heretofore in an attempt to avoid the interference between full packages doffed from immediately opposite spinning units is shown in FIG. 1, wherein two runs of package transferring conveyors 3 are disposed along the respective yarn winding drums 2 extending along the spinning units (not shown) on opposite sides of the machine frame 1. In operation, when a yarn coming out from a spinning unit is wound by the winding drum 2 and formed into a full package 4, it is pushed out of its winding position onto either of the conveyors, where it is stored temporarily for any desired period of time, whereupon the conveyors 3 are initiated at any convenient time by the operator so that the full packages 4 on the conveyors may be moved out of the machine 1 then to be handed over to the transferring system of the subsequent process.

It is evident that, since each row of spinning units has its own package conveyor extending in parallel thereto, no interference between the full packages doffed from the opposite side will take place. However, arrangement of such two longitudinal runs of conveyors will inevitably increase the width of the frame, thus requiring more space and cost for machine installation. Further the frame is made complicated in structure by addition of a conveyor, which will naturally affect the ease of its maintenance. Furthermore, provision of two runs of conveyors will make it difficult to realize simple and smooth connection of the spinning process with the subsequent step in streamlining the transfer of yarn packages.

SUMMARY OF THE INVENTION

Accordingly, it is an object of the present invention to provide a method of transferring full packages in a spinning frame having a single run package conveyor, by which interference of a full package to be doffed from its spinning position with a package already doffed and placed on the conveyor is prevented successfully without reducing the operating efficiency of the machine.

It is another object of the invention to provide a method of transferring full packages which permits simplified structure of the spinning machine with reduced widthwise dimension for less installation space and cost.

It is still another object of the invention to provide a method of transferring full packages which simplifies the connection of the full package conveyor in a spinning process with the counterpart of the subsequent step, thus facilitating automation in handling of yarn packages.

These objects are attained by a package transferring method of the present invention. According to a preferred embodiment of the invention, an automatic doffing unit traveling along the respective spinning units or stations is stopped at a spinning station which calls for doffing of its full package, and is then operated to doff the package only when there is no package on the conveyor at a position corresponding to the spinning station at which the doffing unit is currently stopped. If presence of a package at the corresponding position on the conveyor is detected, on the other hand, the doffing unit resumes its traveling motion without performing a doffing service at the station, reserving that undoffed station for doffing at a later time. When the stations thus reserved for future doffing amount to any predetermined number, the conveyor is started for carrying away the full packages stored thereon and discharging them out from an end of the machine, thus clearing the conveyor of packages. Because doffing of a full package from a spinning station is performed only when a free space is available on the conveyor at a position where the package after being doffed is to be placed, damaging interference between doffed packages on the conveyor may be eliminated.

The invention may be carried into practice in various ways and one embodiment will now be described by way of example with reference to the accompanying drawings in which:

DETAILED DESCRIPTION OF PREFERRED EMBODIMENT

Figure 1:
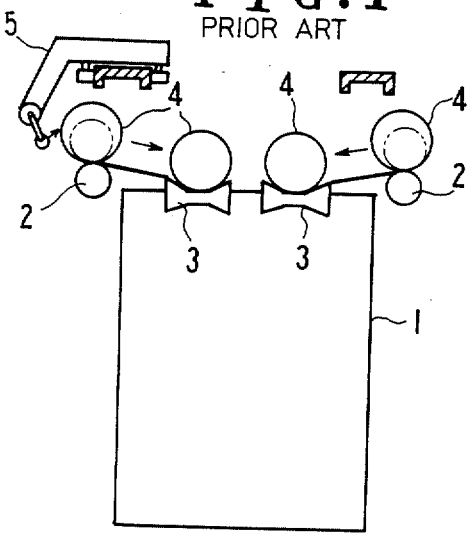
FIG. 1 PRIOR ART
FIG. 1 is a schematic diagram in end view showing a conventional method of transferring packages in a spinning frame having two runs of conveyors.
Figure 2:
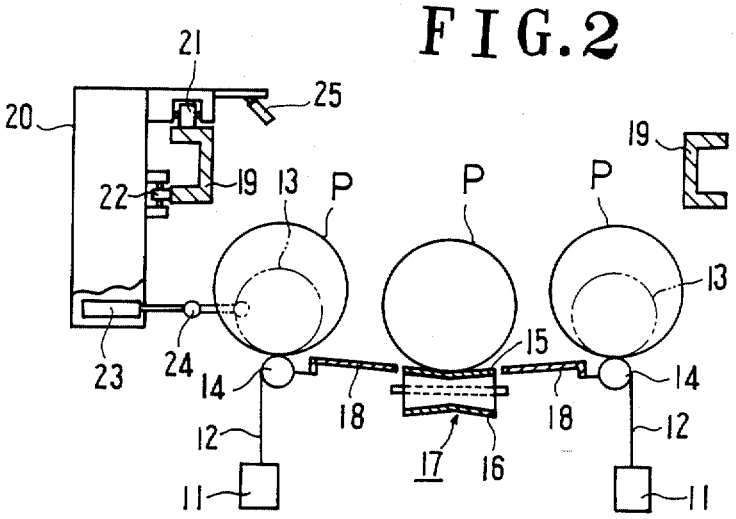
FIG. 2 is a schematic diagram in end view partly in section showing an arrangement of spinning apparatus which performs a method of transferring packages of the present invention.
Figure 3:
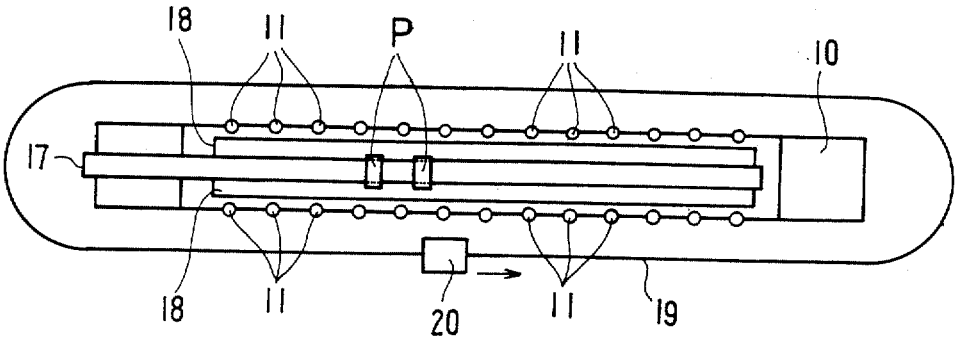
FIG. 3 is a schematic diagram in plan view of a spinning machine which operates according to a package transferring method of the invention.

Reference is made firstly to FIGS. 2 and 3 which illustrate a spinning apparatus which employs a method of package transferring according to the present invention. A spinning machine 10 has a plurality of spinning units or stations 11 juxtaposed in a row on each longitudinal side of the machine. A strand of yarn 12 which is spun by and coming out from each spinning unit 11 is wound into a yarn package 13 by a winding drum 14 which is disposed above and extends along the respective spinning units on each side. On top of the spinning frame 10 and along the longitudinal center thereof is arranged a single run full package conveyor 17 which includes an endless belt 15 extending along the frame and a pulley 16 for driving said belt. On each side of the conveyor 17 is provided a guide rail 18 which is so arranged as to guide a full package P from its winding position onto the conveyor belt 15.

A rail 19 is disposed in such a way as to surround the spinning machine 10 as shown in FIG. 3, and a servicing or doffing unit 20 is moveably carried by the rail 19 via a drive roller 21 and a guide roller 22 as shown in FIG. 2 so that the doffing unit 20 may travel along the rail 19, and therefore along the individual spinning stations 11 on both sides of the machine. The doffing unit 20 is equipped at its bottom with a pusher roller 24 which is operated by a cylinder 23 to push out a full package P onto the conveyor belt 15, and at its top with a photo-electric device 25 which is adapted to detect a full package P present on the conveyor belt 15 by emitting a beam of light against the full package, if any, on the conveyor belt.

Operation of the above-described apparatus, or a method of transferring full packages in the apparatus, with relation to the electric control circuits shown in FIGS. 4 (A) and 4(B) will be now explained.

Figure 4A:
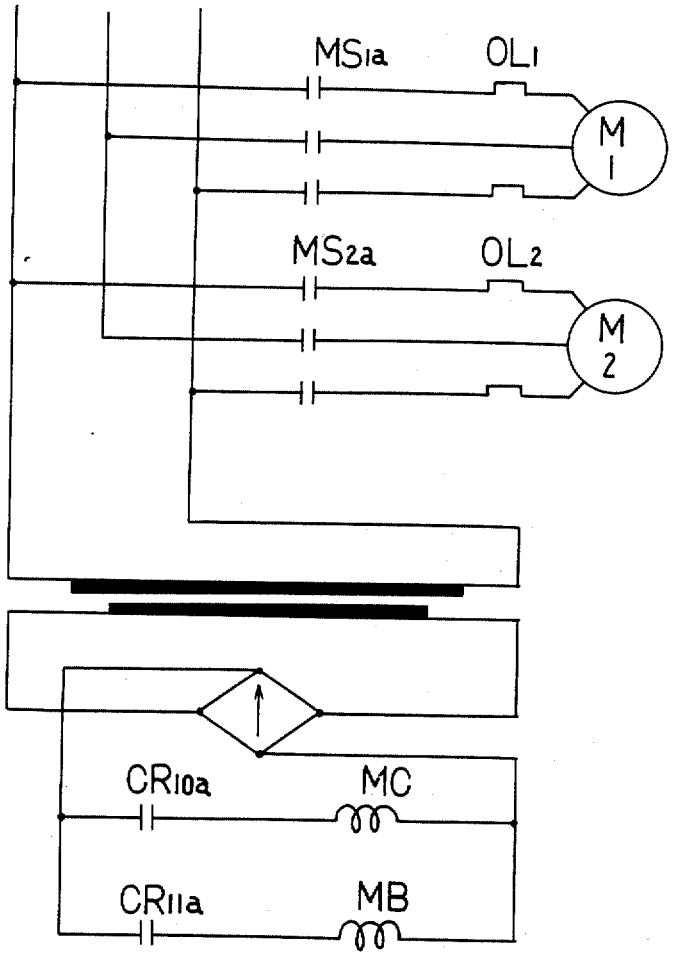
FIGS. 4 (A) and (B) are wiring diagrams of the circuit controlling the operation of a spinning frame which operates according to a package transferring method of the invention.
Figure 4B:
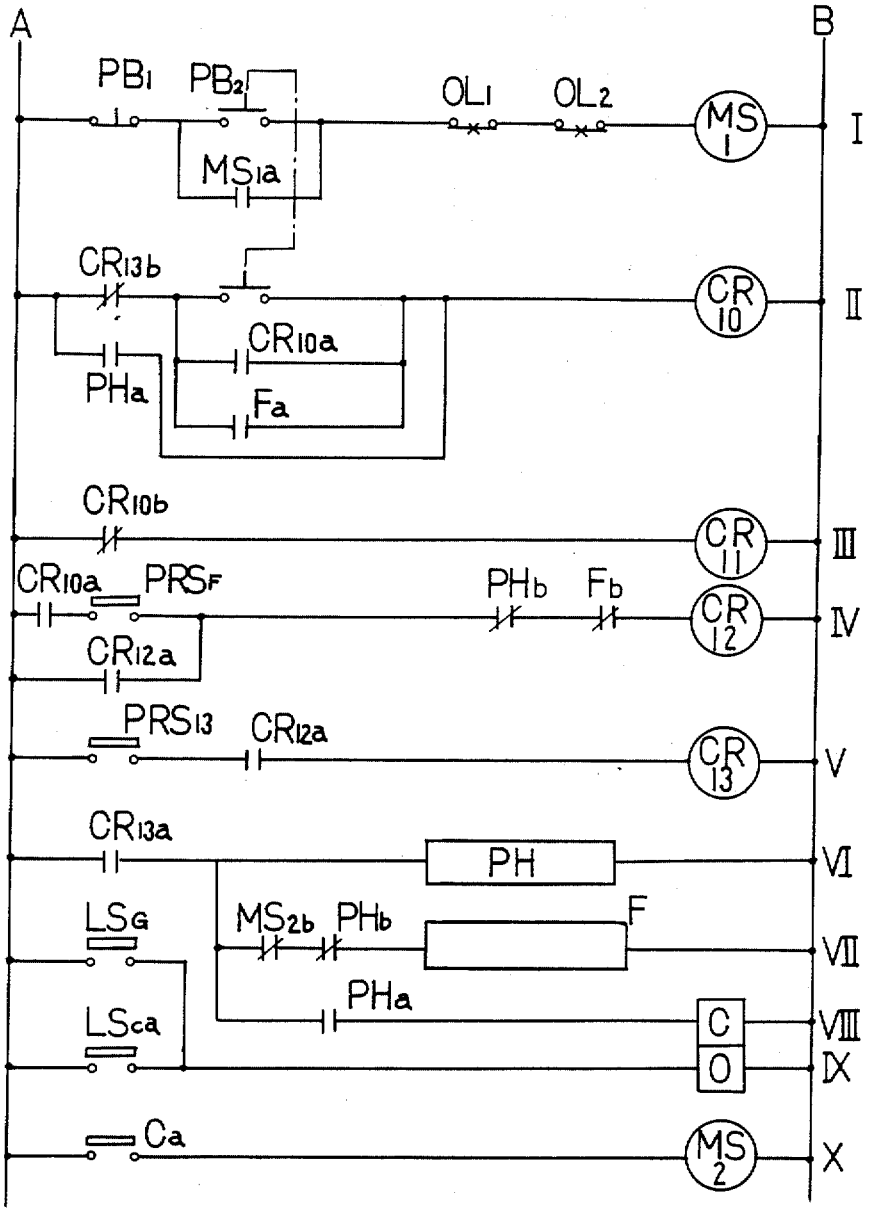

In FIGS. 4(A) and 4(B), M1 represents a motor for driving the doffing unit 20, and M2 a motor for driving the conveyor 17. The motor M1 is started by closing the magnetic switch MS1, while the motor M2 which is normally at a stop may be initiated by energizing the magnetic switch MS2. MC represents a clutch coil which, when excited, engages a clutch of the doffing unit 20, and MB a brake coil which, when excited, applies brake to the doffing unit. The coils MC and MB may be excited by energizing the relays CR10 and CR11, respectively. To stop the traveling doffing unit 20, its clutch is disengaged and the brake is applied; to allow the unit to resume its travel along the rail 19, a reverse procedure is taken.

$PRS_F$ in circuit IV in FIG. 4(B) is a proximity switch which detects a full-package signal provided by a spinning station which calls for a doffing service, and PH in circuit VI is a photo-electric switch which is operated when it detects a package present on the conveyor at a position where the doffing unit 20 is then stopped.

On closing the pushbutton switch PB2 provided in circuit I of FIG. 4(B), the magnetic switch MS1 in the same circuit is energized, closing the NO (or normally-open) points of contact MSla thereby to place the magnetic switch MS1 in a self-hold state and, simultaneously, initiating the doffing unit drive motor M1. Closure of the pushbutton switch PB2 simultaneously energizes the relay CR10 connected in circuit II, closing the NO points of contact CR10a thereby to allow the relay CR10 to be self-held and, simultaneously, energizing the coil MC to engage the clutch of the doffing unit. Simultaneously with the above operation of the relay CR10, its NC (or normally-closed) points of contact CR10b in circuit III is opened to de-energize the relay CR11, thereby causing current flowing in the coil MB to be shut off to cause the doffing unit brake to be released. In this way, the doffing unit 20 is started to travel along its rail 19.

While the doffing unit 20 is traveling at a given speed along the rail 19, therefore along the respective spinning stations 11 of the spinning frame 10, a strand of yarn 12 is produced at each of the spinning stations and then wound into a yarn package 13 by the winding drum 14. As the yarn package 13 increases its diameter, with progression of the spinning and winding operation, substantially to a predetermined size as shown by reference symbol P, the spinning station stops its operation automatically and is placed in a ready-for-doffing state with a full-package signal provided thereby. The full-package signal may be provided by protruding of a projection which may be sensed by a proximity switch.

As the doffing unit 20 moves close enough to the spinning station which has thus provided the full-package signal calling for doffing of its full package P, the proximity switch PRSF mounted on the doffing unit and shown in circuit IV in FIG. 4(B) detects the full-package signal from the spinning station in question and, accordingly, its points of contact are closed thereby to energize the relay CR12, which is then self-held by closing its NO points of contact CR12*a*. Simultaneously, the other NO contact points CR12*a* in circuit V are also closed. Subsequently, the contact points of the proximity switch PRS13 in circuit V for locating the doffing unit 20 at its stop position of the spinning station are closed thereby to energize the relay CR13. Consequently, the NC points of contact CR13*b* in circuit II are opened to break the same circuit, thereby de-energizing the relay CR10, with the result that the doffing unit clutch is disengaged. Simultaneously, the NC points of contact CR10b in circuit III are closed again to energize the brake control relay CR11, resulting in application of the doffing unit brake. In this way, the doffing unit 20 is caused to stop at a designated doffing position of the station which calls for doffing service.

Using its photo-electric device 25, the doffing unit 20 which is located at its doffing position checks for a full package P which may have already been doffed and placed on the conveyor 17 at a position corresponding to the spinning station at which the doffing unit is currently stopped.

When there is no full package at the corresponding position on the conveyor 17, namely if no full package is detected there, the photo-electric switch in circuit VI remains de-energized and its NC points of contact PHb in circuit VII retain their closed state. Therefore, the doffing unit 20 is operated to perform its doffing service at the designated station under the control of the doffing control circuit F. In the doffing operation, the pusher roller 24 provided at the bottom of the doffing unit pushes the full package P, displacing it from its winding position onto the conveyor 17. When such doffing operation has been completed, a doffing-complete signal is transmitted, thereby closing the NO points of contact Fa in circuit II and, simultaneously, opening the points of contact Fb in circuit IV. Consequently, the relay CR12 is de-energized, thereby opening the NO points of contact CR12*a* in circuit V and, therefore, de-energizing the relay CR13. Then, the NC points of contact CR13 in circuit II are closed to energize the relay CR10, and because the NO points of contact CR10*a* are closed, the relay CR10 is self-held. Making of circuit II in turn breaks circuit III by opening the NC contact points CR10*b*, thus de-energizing the relay CR11. As a result, the doffing unit clutch is engaged and its brake is released, so that the doffing unit 20 resumes its traveling motion along the rail 19.

Unlike the above event, on the other hand, if a full package P is present at the aforementioned corresponding position on the conveyor 17, firstly the photo-electric switch PH is energized. Its NC points of contact PHb in circuit VII are thereby opened and therefore no current flows in the doffing control circuit F, so that the doffing unit 20 will not perform its doffing service at the spinning station at which it is currently stopped. Closure of the photo-electric switch PH acts also on the NO contact points PHa in circuit VIII to close, and the counter C connected in the same circuit for counting such an undoffed or reserved station is caused to operate. In addition, closure of the photo-electric switch PH closes the other NO contact points PHa in circuit II thereby energizing the relay CR10 and then closing the contact points CR10*a*, and also acts on the NC points of contact PHb in circuit IV to open, causing the relay CR12 to be de-energized. Consequently, the relay CR13 is also de-energized and the NC points of contact CR13*b* in circuit II are thereby closed, thus placing the relay CR10 in a self-held state. In this way, the doffing unit clutch is engaged and its brake is released, allowing the doffing unit 20 to travel again along the rail 19 until the next full-package signal is sensed by its proximity switch $PRS_F$.

As mentioned in the above, each time the photo-electric switch PH in circuit VI is energized, in other words, in each event that no doffing service is provided to a spinning station, at which the doffing unit 20 is stopped because of a full-package signal calling for a doffing service, because a package is already present on the conveyor 17 at a position corresponding to the spinning station, the undoffed or reserved station is counted by the counter C. As the number of such reserved stations is increased, amounting to a predetermined value (which may include "one"), the NO contact points Ca in circuit X is closed, energizing the magnetic switch MS2 for controlling the operation of the conveyor drive motor M2. Energization of the magnetic switch MS2 closes its associated NO contact points MS2*a* thereby to start the conveyor drive motor M2. As a result, the conveyor belt 15 is driven by the motor M2 via the drive pulley 16, so that the full packages P stored on the belt are conveyed to an end of the frame 10, where they are delivered out of the frame by transferring means (not shown) of the subsequent process. When all the full packages P on the conveyor belt 15 have been discharged out of the spinning frame, the switch LSca in circuit IX is closed and the counter C is thereby zeroed or reset. Simultaneously, the NO contact points ca. The number of rotations of the drive pulley can be counted while the pulley is being driven, and when the number of rotations counted corresponds to a length equal to the length of the machine, at which time all of the full packages will have been discharged, the switch LSca is closed to reset the counter C. in circuit X are opened again to de-energize the magnetic switch MS2, with the result that the conveyor drive motor M2 is brought to a stop.

In order to avoid interference between a full package P moving with the conveyor belt 15 and another full package to be doffed during movement of the belt, it is so arranged that no doffing will take place while the conveyor is set in motion even if a package at a certain spinning station happens to become full and the full-package signal is detected by the traveling doffing unit 20. The motor M2 which drives the pulley 16 is preferably connected to the doffer 20 by a signal line so that a signal for stopping doffing motion is sent to the doffer while the motor M2 is in operation.

As it is now understood by those skilled in the art, because an interval of time between actual doffing operations varies from time to time due to unpredictable yarn breaks and reservations of package doffing, the sequence of order of the spinning stations to be serviced by the doffing unit will become random. Therefore, the number of full packages P stored on the conveyor 17 during a given length of time after completion of the previous transfer of full packages will naturally vary from time to time.

Furthermore, undoffing of a package during movement of the conveyor 17 means downtime in the operation of the spinning machine. Therefore, the manner in which the conveyor 17 is driven will influence the working efficiency of the spinning machine. To permit the machine to operate at its maximum efficiency by allowing the conveyor 17 to be initiated at an optimum timing for the purpose, it is preferable that an optimum number of undoffed or reserved stations should be calculated and set in the counter C with various governing factors such as frequency of yarn breaks, speed at which the doffing unit travels, speed at which the conveyor is driven, spinning conditions, etc. taken into careful consideration.

In order to avoid double counting of the same reserved station, a reset switch $LS_G$ is provided at an end of the machine which, when closed, resets the counter C to "0" if the number of reserved stations fails to amount to the predetermined value even after a complete turn of the doffing unit 20 along its rail 19. The reset switch $LS_G$ can be mounted on the doffer 20 to be actuated by a dog at the end of the rail 19 when the doffer 20 comes to the end of the rail.

Figure 5:
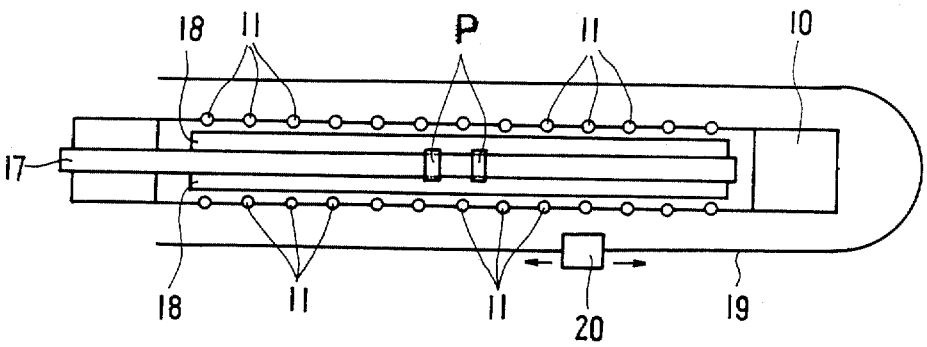
FIG. 5 is a schematic diagram in plan view of a spinning machine which operates according to a modified method of transferring packages of the invention.

As shown in FIG. 5, it may be so arranged that the doffing unit 20 is reversible, or moveable in both directions. Furthermore, it may be contemplated that the counter C is connected with a computer which is so designed to calculate the optimum number of reservable stations in accordance with the varying conditions under which the spinning machine is operating, the conveyor 17 being initiated when the reserved stations amount to said optimum number.

As it is now apparent to those skilled in the art, according to a full package transferring method of the present invention in a spinning frame having a plurality of spinning units or stations arranged in a row on each longitudinal side of the frame, a single run package conveyor disposed between the opposite rows of the spinning stations and a doffing unit which provides doffing service at each designated station while traveling around the machine, the doffing unit provides its doffing service to a station which calls for doffing of its full package only when no package is present on the conveyor at a position corresponding to that station, but it defers its doffing operation at the station if a package is present at said corresponding position or the conveyor resumes its traveling. The conveyor having doffed packages stored thereon is driven to move when the packages undoffed or reserved for later doffing amount to a predetermined number so that the doffed packages may be cleared of the conveyor and transferred out of the machine. In this way, the danger of interference between packages on the conveyor, as observed heretofore in a conventional method in a spinning machine having a single run conveyor, may be removed without affecting the operating efficiency of the machine. Since only a single run of conveyor will do for transferring of full packages according to the present invention, the machine structure may be simplified with the reduced count of relevant parts, ease of maintenance and less space for machine installation due to decreased machine width. Furthermore, because the conveyor on the spinning machine may have only one delivery exit, connection of the conveyor on the spinning machine with conveying means of the subsequent process may be greatly facilitated, thus contributing to ease of automation in package transferring and handling.

While the invention has been illustrated and described with reference to specific embodiments, it is to be understood that various modifications in the details of the method may be made without departing from the spirit and scope of the invention.

What is claimed is:

1. A method of transferring full yarn packages in a spinning machine from any of a plurality of spinning stations arranged in two rows on each longitudinal side of the machine to a package tranferring conveyor disposed between said two rows of spinning stations and extending to an end of the machine for removing the full yarn packages from the machine, said conveyor being normally stopped, and said machine having a doffing unit movable around the machine for stopping at any of said spinning stations and having a normally inactive doffer thereon for doffing a package from any one of said spinning stations onto said conveyor, comprising the steps of:

starting said doffing unit in its said movement around said machine;

providing a signal from each of said spinning stations, respectively, when a full yarn package thereat requires doffing from that spinning station onto a position of said conveyor adjacent to the spinning station;

stopping said doffing unit at one such spinning station in response to said signal therefrom;

detecting whether a previously doffed yarn package is on said stopped conveyor at said position adjacent to the spinning station; doffing activiating said normally inactive doffer on said doffing unit to doff said full yarn package from said one spinning station onto said adjacent conveyor position only if no package is detected thereon during said detecting step, but leaving said doffer inactive and again starting doffing unit in its said movement around said machine and recording one count if a yarn package is detected thereon during said detecting step;

in random sequence with respect to each other of such spinning stations which provides a said signal, repeating all of said steps of stopping said doffing unit thereat responsive to said signal therefrom, detecting whether a previously doffed yarn package is on said stopped conveyor at a position adjacent to the spinning station, and activating said doffer of the doffing unit to doff a full yarn package therefrom onto said conveyor position only if no package is detected thereon during said detecting step, but leaving said doffer inactive and again starting said doffing unit in its said movement around said machine and recording one added count if a yarn package is detected thereon during said detecting step, unit a predetermined number of said recorded counts is reached; and starting said package transferring conveyor to move all of said full yarn packages thereon to discharge from one end of said conveyor when said predetermined number of recorded counts is reached, and deactivating said doffing unit during said conveyor movement.

2. A method according to claim 1, wherein each said detecting step comprises emitting a beam of light from said doffing unit towards said conveyor position adjacent each such spinning station, whereby interruption of said beam determines that a said previously doffed yarn package is thereon.

3. A method according to claim 1, wherein said doffing unit travels in only one direction during its said movement around said machine.

4. A method according to claim 1, which further comprises selectively reversing the direction of movement of said doffing unit between any two of said doffing unit stopping steps.

* * * * *

UNITED STATES PATENT AND TRADEMARK OFFICE

CERTIFICATE OF CORRECTION

PATENT NO. : 4,582,270

DATED : April 15, 1986

INVENTOR(S) : I. ASAI ET AL.

It is certified that error appears in the above-identified patent and that said Letters Patent is hereby corrected as shown below:

Title page:

Add to the list of inventors:

Osamu Suzuki, Obu, Japan
Takayuki Morita, Kariya, Japan

After "Attorney, Agent, or Firm" the name "Hafner" should be --Haffner--.

Column 1, line 27, after the first word "full", "package" should be --packages--.

Column 1, line 28, after the first word "full", "packages" should be --package--.

Column 1, line 62, there should be a comma after "ther".

Column 4, line 25, "PRSF" should be --$PRS_F$--.

Column 5, lines 59 and 60, delete "Simultaneously, the NO contact points ca.".

Column 5, line 65, after "C." and before "in", add --Simultaneously, the NO contact points CA--.

Column 7, line 33, "tranferring" should be --transferring--.

Column 7, line 48, the second word "of" should be --on--.

UNITED STATES PATENT AND TRADEMARK OFFICE

CERTIFICATE OF CORRECTION

PATENT NO. : 4,582,270

DATED : April 15, 1986

INVENTOR(S) : I. ASAI ET AL.

It is certified that error appears in the above-identified patent and that said Letters Patent is hereby corrected as shown below:

Column 8, line 5, the word "doffing" should be deleted.

Column 8, line 11, between "starting" and "doffing", the word --said-- should be inserted.

Column 8, line 28, the word "unit" should be --until--.

Signed and Sealed this

*Twenty-ninth* Day of *July 1986*

[SEAL]

*Attest:*

DONALD J. QUIGG

*Attesting Officer*

*Commissioner of Patents and Trademarks*